US008783159B2

(12) United States Patent
Gomez et al.

(10) Patent No.: US 8,783,159 B2
(45) **Date of Patent: *Jul. 22, 2014**

(54) SELF LOADING FIREARM BOLT CARRIER WITH INTEGRAL CARRIER KEY AND ANGLED STRIKE FACE

(71) Applicant: LWRC International, LLC, Cambridge, MD (US)

(72) Inventors: Jesus S. Gomez, Trappe, MD (US); Jason Lee Miller, Hurlock, MD (US); Robert S. Schilling, Easton, MD (US); Michael R. Llewellyn, Salisbury, MD (US)

(73) Assignee: LWRC International LLC, Cambridge, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/769,224

(22) Filed: Feb. 15, 2013

(65) Prior Publication Data

US 2014/0026744 A1 Jan. 30, 2014

Related U.S. Application Data

(63) Continuation of application No. 12/801,001, filed on May 14, 2010, now Pat. No. 8,387,513.

(51) Int. Cl.
*F41A 5/18* (2006.01)

(52) U.S. Cl.
USPC ..... 89/191.01; 89/193

(58) Field of Classification Search
USPC ..... 89/191.01–193, 179, 156
See application file for complete search history.

(56) References Cited

U.S. PATENT DOCUMENTS

| | | | |
|---|---|---|---|
| 5,551,179 | A | 9/1996 | Young |
| 5,770,814 | A | 6/1998 | Ealovega |
| 6,722,255 | B2 | 4/2004 | Herring |
| 6,848,351 | B1 | 2/2005 | Davies |
| 7,299,737 | B2 | 11/2007 | Hajjar et al. |
| 7,316,091 | B1 | 1/2008 | Desomma |
| 7,461,581 | B2 | 12/2008 | Leitner-Wise |
| 7,634,959 | B2 | 12/2009 | Frickey |
| 7,661,219 | B1 | 2/2010 | Knight et al. |
| 7,784,211 | B1 | 8/2010 | Desomma |

(Continued)

OTHER PUBLICATIONS

David Crane; LMT MRP Piston/Op-Rod System v. HK416: 2,000-Round Head-to-Head Test; Defense Review (www.defensereview.com); Feb. 23, 2009 (5 web pages), plus 6 enlarged photographs from the web pages.

*Primary Examiner* — Michael David
(74) *Attorney, Agent, or Firm* — Squire Patton Boggs (US) LLP

(57) ABSTRACT

A bolt carrier for use with the AR15/M16 family of firearms is provided. The bolt carrier includes an integrally formed carrier key and spherical strike face surrounded by a cylindrical counterbore made with a downward angle to act against the tilting force imparted by the operating rod of the firearm's gas operating system. The outer surface of the carrier includes upper and lower running rails that all extend fully to the front face of the carrier to lengthen the carrier's rail support or bearing surfaces against the receiver. To improve the robust operation of the firearm in over the beach operations, the bottom and rear of the receiver extension has drain holes formed through which water is forced out of the receiver extension by the reciprocating action of the bolt carrier when the weapon is fired.

10 Claims, 9 Drawing Sheets

(56) References Cited

U.S. PATENT DOCUMENTS

| | | | | |
|---|---|---|---|---|
| 8,181,563 | B1 | 5/2012 | Peterken | |
| 8,245,427 | B2 | 8/2012 | Gomez | |
| 8,387,513 | B2 * | 3/2013 | Gomez et al. | 89/191.01 |
| 2005/0011345 | A1 | 1/2005 | Herring | |
| 2008/0016684 | A1 | 1/2008 | Olechnowicz et al. | |
| 2010/0269682 | A1 | 10/2010 | Vuksanovich et al. | |
| 2010/0319527 | A1 | 12/2010 | Giefing | |
| 2012/0137869 | A1 | 6/2012 | Gomez et al. | |
| 2012/0152105 | A1 * | 6/2012 | Gomez et al. | 89/191.01 |

* cited by examiner

PISTON SET AND CARRIER GROUP IN BATTERY

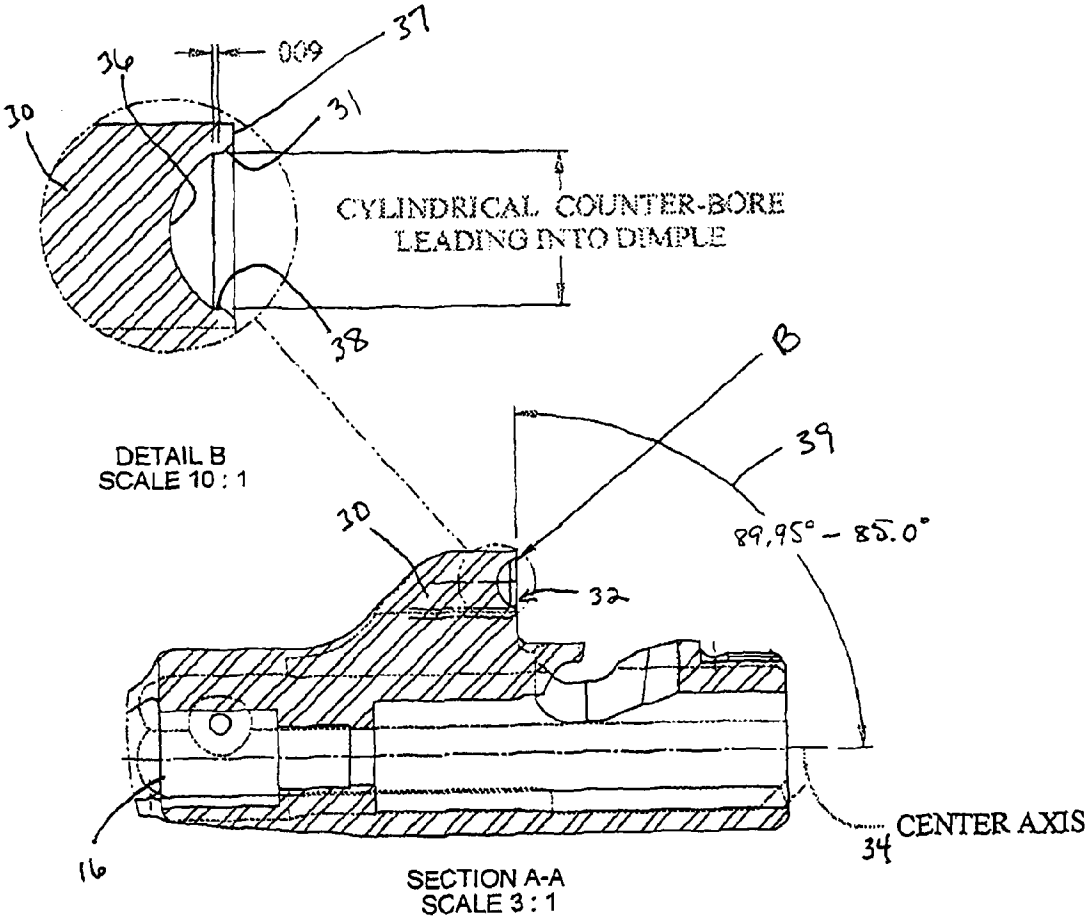
FIG. 4B
FIG. 4A
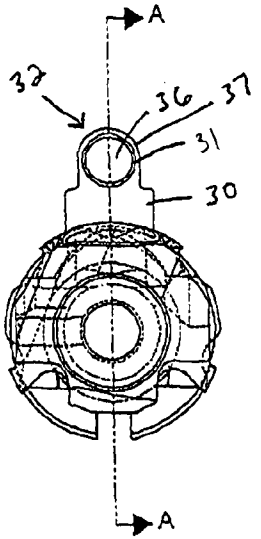
FIG. 4

ACTION INITIATED

DRAIN HOLES FOR WATER AND DEBRIS

RECEIVER EXTENSION( BUFFER TUBE)

SELF LOADING FIREARM BOLT CARRIER WITH INTEGRAL CARRIER KEY AND ANGLED STRIKE FACE

This is a continuation application claiming benefit of application Ser. No. 12/801,001 filed on May 14, 2010, issuing as U.S. Pat. No. 8,387,513 on Mar. 5, 2013, hereby incorporated by reference as if set forth herein in its entirety.

BACKGROUND OF THE INVENTION

1. Field of the Invention

The present invention relates to self-loading firearms. More particularly, the present invention relates to the operating system of indirect gas-operated firearms in the AR15/M16 series of firearms and specifically the bolt carrier for use in such firearms.

2. Description of the Related Art

The AR15/M16 family of weapons and their derivatives including indirect gas operated versions, have been in use by the military and civilian population for many years. An essential part of this firearm's design is the bolt carrier which typically includes a bolt mounted in the carrier for axial sliding movement and rotation, a firing pin slidably mounted within the bolt and bolt carrier for restricted reciprocating axial movement, and a cam pin for producing relative rotation between the bolt and the bolt carrier.

The bolt carrier is generally cylindrical in shape with a longitudinally extending circular bore throughout its length. An elongated opening is provided in the top and bottom of the carrier to allow the hammer to extend into the interior of the bolt carrier and strike the firing pin. The rear of the carrier is received within the firearm receiver and the front of the carrier houses the bolt. The upper surface of the carrier immediately adjacent the front face includes a flat shelf for engagement with a charging handle.

The top of the carrier in front of the opening is machined to receive a carrier key which operates in conjunction with the operating rod of the firearm's gas operating system to cycle the bolt action in automatic and semi-automatic operation. A carrier with a separate carrier key that is attached to the carrier with fasteners is set forth in U.S. Pat. No. 7,461,581 ("the '581 patent"), which is owned by the assignee of the present application and is hereby expressly incorporated by reference as if fully set forth herein. This two-part construction necessitates careful machining of both the carrier and the carrier key to ensure a close fit within a narrow tolerance.

In a conventional indirect gas operated firearm, the operating rod of the gas operating system contacts the strike face of the carrier key after the weapon is fired and gas pressure displaces the operating rod rearwardly. Because the strike face is above the central axis of the bolt carrier, an undesirable phenomenon known as carrier tilt occurs during the normal operation of the firearm. Carrier tilt can be defined as the rear of the carrier tilting downwardly when the strike face has been contacted by the operating rod, resulting in the rearward movement of the carrier being resisted when the now off-axis carrier strikes the forward leading edge of the receiver extension. Eliminating carrier tilt would be a very desirable attribute.

About the exterior of the bolt carrier are a series of longitudinally extending lands or rails, usually four, which make contact with the cylindrical interior surface of the upper receiver of the firearm and serve to align the bolt carrier within the receiver. The rails include two upper rails and two lower rails spaced from one another about the exterior circumference of the bolt carrier. The upper rails extend from the elongated opening to the rear edge of the charging handle engagement shelf. The two lower rails are generally parallel with the upper rails and extend from the elongated opening all the way to the front face of the carrier.

Conventionally, the rails are contiguous and held to tight tolerance with the running surfaces in the upper receiver. Firearms such as the Stoner type rifle are very prone to stoppages and malfunctions when sand or dirt works into the receiver. Therefore, a need exists for a rail configuration that supports the carrier while reducing the likelihood of firearm malfunction when exposed to dirt and sand.

The rear end of the carrier typically does not contact the inside of the receiver but rather is supported by the longitudinal rails. To further support the carrier against carrier tilt, the rear of the carrier may be provided with a generally cylindrical boss having an outer diameter larger than the main body of the bolt carrier as described in a copending application filed on Oct. 10, 2008, entitled "Automatic Rifle Bolt Carrier with Fluted Boss", by Jesus S. Gomez and Jason Miller (hereinafter, "the Gomez application"), which is also owned by the assignee of the present application and is hereby expressly incorporated by reference as if fully set forth herein. The boss in the Gomez application has an outer diameter large enough to make contact with the cylindrical inside of the receiver extension to ensure that the carrier centers therein.

Firearms based on the AR15/M16 family are the primary weapon of choice for military units in the United States and abroad. Highly trained units from all branches of service often find themselves operating in aquatic conditions prior to coming on land. The inability of the AR15/M16 series of weapons to be fired when water is present in the operating system puts these military personnel in a compromising position. With the current AR15/M16 series of weapons, and their derivatives, the firearm must be drained of all water prior to being discharged. This draining is not convenient or practical for a soldier who may come under fire immediately upon landing on a beach. Such situations are typically referred to as "over the beach operations". Incorporating features into the operating system which allow the firearm to be immediately discharged upon exit from an aquatic environment would be highly desirable. One such feature is set forth in the Gomez application, namely, a series of longitudinal cuts or flutes spaced about the circumference of the boss to allow for water to pass by the boss. Additional water removal features would also be desirable.

It would be highly advantageous, therefore, to remedy the foregoing and other deficiencies inherent in the prior art.

SUMMARY OF THE INVENTION

In view of the foregoing, one object of the present invention is to overcome the shortcomings in the design of bolt carriers and bolts for self-loading firearms as described above.

Another object of the present invention is to overcome the phenomenon of carrier tilt in gas-operated automatic and semi-automatic firearms.

Yet another object of the present invention is to provide a bolt carrier for a gas-operated automatic or semi-automatic firearm having an carrier key integrally formed with the carrier to facilitate carrier design and manufacture.

A further object of the present invention is to provide a bolt carrier for a gas-operated automatic or semi-automatic firearm in accordance with the preceding objects in which the integral carrier key has a spherical strike face and a cylindrical counterbore which acts against the off-axis force imparted by the operating rod of the firearm's gas operating system during operation of the firearm to prevent carrier tilt.

A still further object of the present invention is to provide a bolt carrier for a gas-operated automatic or semi-automatic firearm in accordance with the preceding objects in which the rear of the carrier includes an enlarged boss as described in the Gomez application that engages the receiver to further reduce carrier tilt.

Another object of the present invention is to provide a bolt carrier for a gas-operated automatic or semi-automatic firearm in accordance with the preceding objects in which the boss has a plurality of cuts or flutes formed therein as described in the Gomez application to allow for water transfer, making the firearm safe for use in over the beach operations.

Yet another object of the present invention is to provide a bolt carrier for a gas-operated automatic or semi-automatic firearm in accordance with the preceding objects in which the rails on the upper surface of the carrier are extended all the way to the front face of the carrier to further mitigate carrier tilt.

A further object of the present invention is to provide a bolt carrier for a gas-operated automatic or semi-automatic firearm in accordance with the preceding objects in which the rails of the carrier have relief or sand cuts that provide a place for dirt and sand to accumulate so that such debris will not jam the firearm.

Another object of the present invention is to provide a bolt carrier for a gas-operated automatic or semi-automatic firearm in accordance with the preceding objects in which drain holes are provided in the bottom and rear of the receiver extension to allow water in the receiver extension to escape.

Yet another object of the present invention is to provide an improved bolt carrier in accordance with the preceding objects that can be used to upgrade existing weapons in the field without the requirement for any tools.

A still further object of the present invention to provide an improved bolt carrier for a rotary bolt action gun that is not complex in structure and which can be manufactured at low cost but yet greatly increases the reliability and safety of the firearm.

In accordance with these and other objects, the present invention is directed to a firearm from the AR15/M16 family, or an indirect gas-operated derivative, having a bolt carrier as previously described, with an improved bolt carrier which can be retrofitted to existing firearms of the AR15/M16 family of firearms using an indirect gas-operated system without any modification to the receiver of the firearm or any other part thereof.

The bolt carrier has several features that reduce carrier tilt. First, the carrier includes an integrally formed carrier key having a downwardly angled spherical strike face with a cylindrical counterbore to act against the tilting force imparted by the operating rod of the gas operating system. Second, the rear of the carrier includes a boss having a larger diameter relative to the main body of the carrier to ensure that the carrier is centered in the receiver and receiver extension, further mitigating carrier tilt as discussed previously in connection with the Gomez application. Third, the upper rails on the outer circumference of the carrier are extended to the front face of the carrier to provide longer rail support surfaces and still further reduce tilting of the carrier during operation.

In addition to reducing carrier tilt, the bolt carrier according to the present invention also includes features that reduce manufacturing costs and improve the robust operation of the firearm in adverse conditions. In particular, the bolt carrier of the instant invention has a carrier key integrally formed with the bolt carrier as one piece. This one-piece construction reduces manufacturing complexity and cost.

Further, for over the beach operations, the sides of the boss at the rear of the carrier have cuts or flutes formed therein to allow water to pass as already discussed. According to the present invention, these flutes work in conjunction with drain holes that are provided in the bottom and rear of the receiver extension. Specifically, as the weapon is fired, the bolt carrier moves rearwardly into the receiver extension. Water present in the receiver extension is forced, by the pumping action created by the moving bolt carrier, outwardly through the drain holes in the receiver extension to empty the receiver extension of water. In addition, water can pass through the flutes in the boss to exit the receiver and receiver extension by moving past the carrier as a result of the same pumping action created by the cycling of the bolt carrier during firing.

In addition, for improved performance in sandy and dirty conditions, the rails on the forward end of the carrier that contact the receiver have relief or sand cuts formed therein to provide a recess for dirt and dust to accumulate during operation of the firearm so that debris will not jam the weapon.

Finally, to improve the durability of the weapon, the operating rod is preferably made of a super alloy with high nickel and cobalt content.

These together with other improvements and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 4 is an end view of the integrally formed carrier key and strike face of the bolt carrier of FIGS. 1-3.

FIG. 4A is a cross-sectional view taken along line A-A of FIG. 4.

FIG. 4B is an enlarged view of detail B of FIG. 4.

DETAILED DESCRIPTION OF THE PREFERRED EMBODIMENTS

Figure 1:
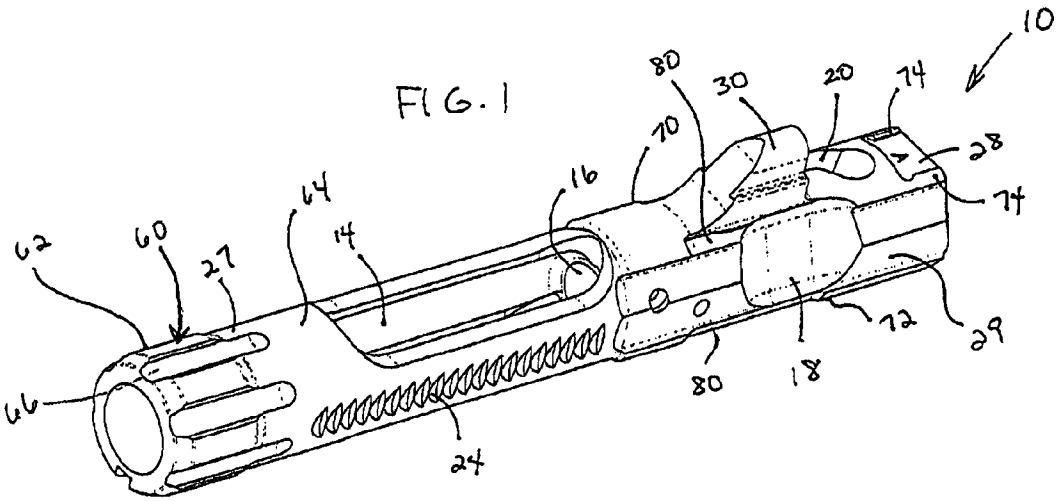
FIG. 1 is a perspective view of a bolt carrier according to the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
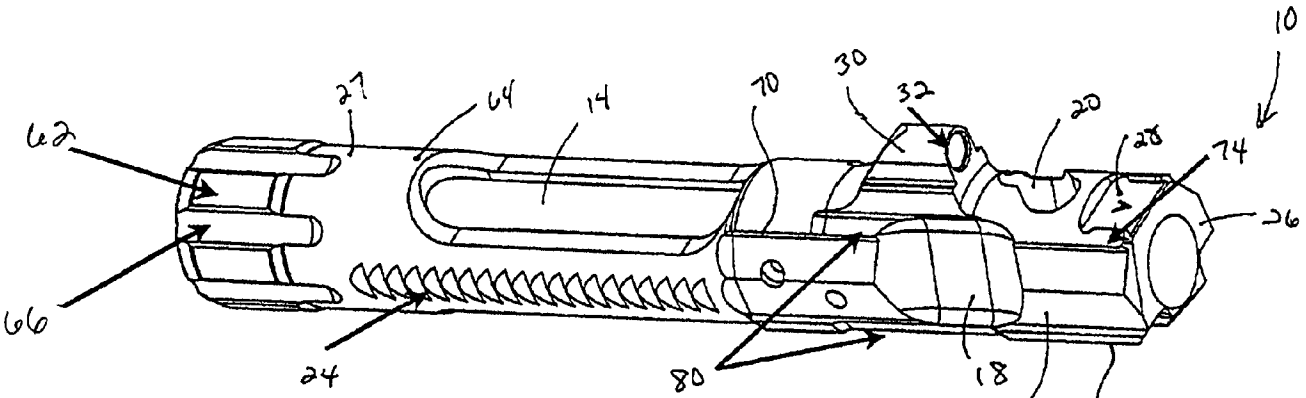
FIG. 2 is another perspective view of the bolt carrier shown in FIG. 1.

As used herein, the word "front" or "forward" corresponds to the end of the bolt carrier where the strike face is located, i.e., to the right as shown in FIGS. 1 and 2. The "rear" or "rearward" or "back" corresponds to the direction opposite the end of the bolt carrier where the strike face is located, i.e., to the left as shown in FIGS. 1 and 2. The term "battery" refers to the position of readiness of a firearm for firing.

Figure 3A:
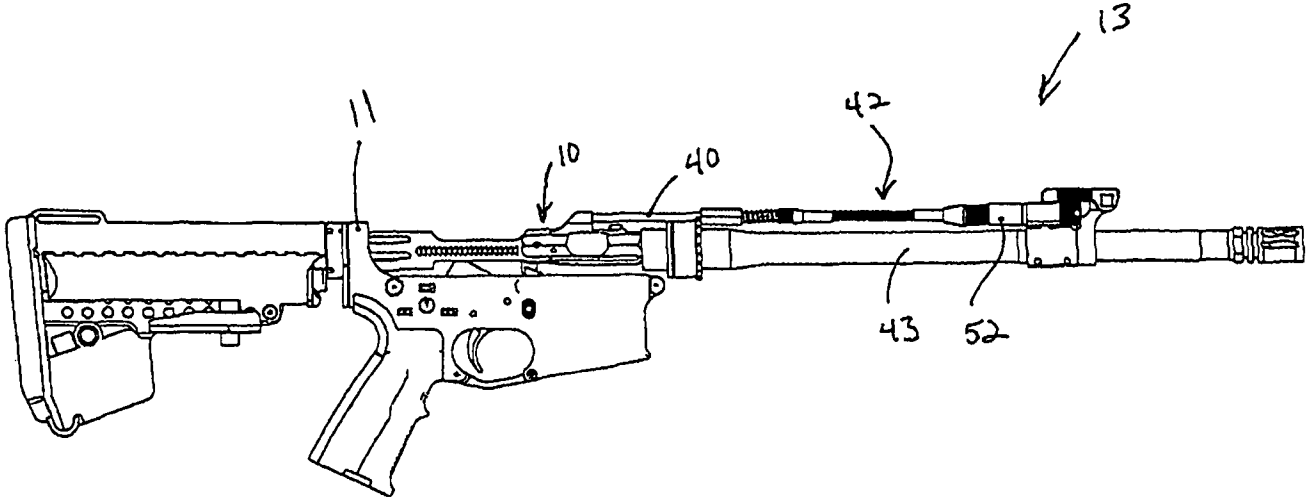
FIG. 3A shows the bolt carrier of FIGS. 1 and 2 with the other components of a firearm in battery.
Figure 3B:
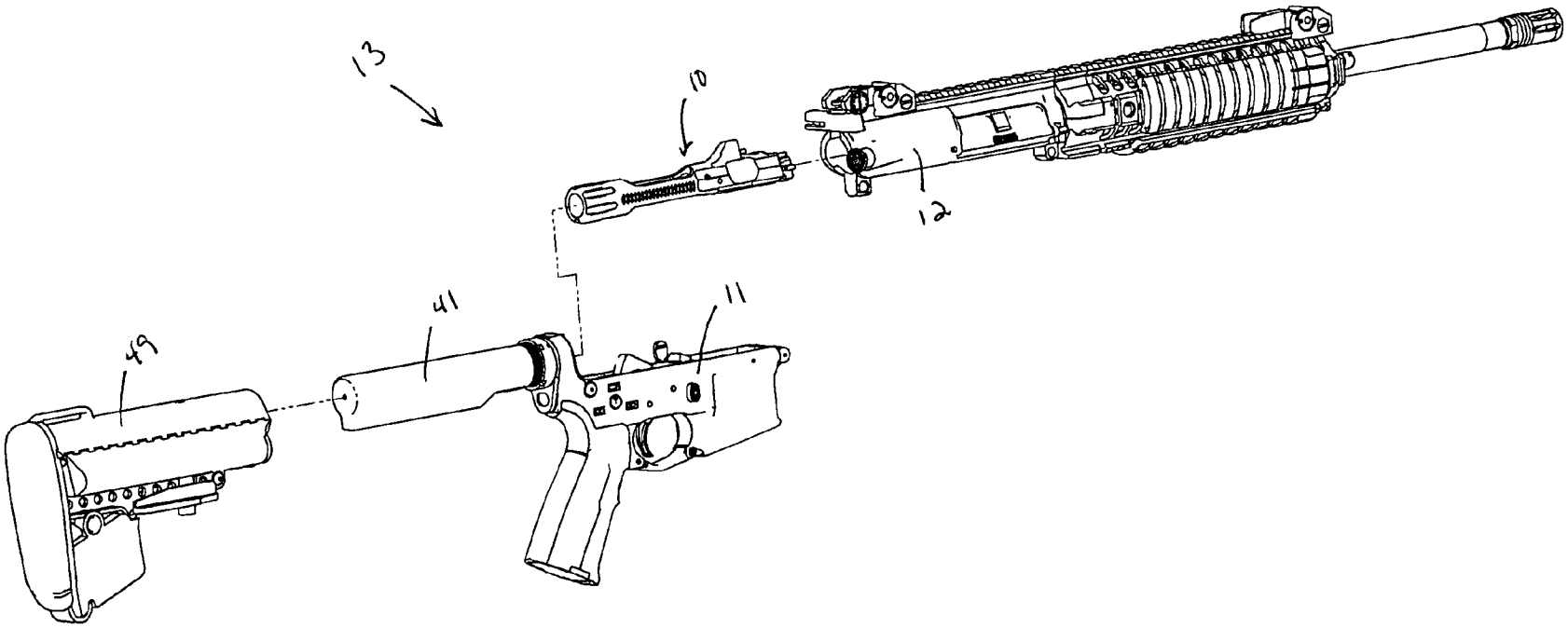
FIG. 3B is an exploded view of the firearm components shown in FIG. 3A.

As shown in FIGS. 1 and 2, the present invention is directed to a bolt carrier generally designated by reference numeral 10. It will be understood that bolt carrier 10 is intended to be employed with any indirect gas-operated firearm. It will also be understood that bolt carrier 10 is carried by an upper receiver 12 that cooperates with a lower receiver 11 and receiver extension 41 of a gas-operated automatic or semi-automatic firearm, generally designated by reference numeral 13, as shown in FIGS. 3A and 3B. As is known, the firearm 13 includes a gas operating system generally designated by reference numeral 42, and a barrel 43. The receiver extension is received within the buttstock 49.

In FIGS. 1 and 2, the preferred embodiment of the bolt carrier 10 is shown. The bolt carrier 10 includes a hammer clearance slot 14 which permits the hammer (not shown but well known in the art) to extend into the bolt carrier 10 and strike a firing pin (not shown) positioned in bore 16.

The exterior of the carrier includes a door opener 18 which provides room for the door latch (well known in the art) to close, and a cam slot 20 which provides a contained area for the cam pin (not shown) to rotate thus allowing the bolt 22 (see FIG. 6) to move rearwardly and rotate axially in the bolt carrier 10; the cam pin retains the bolt 22 within the bolt carrier 10 as is known in the art. One side of the bolt carrier 10 is provided with forward assist notches 24 as is well known in the art. The top of the carrier immediately adjacent the front face 26 thereof has a flat charging handle engagement shelf 28 for a charging handle 82 (see FIGS. 7 and 8), as is also known in the art.

The top of the bolt carrier is formed with an integral carrier key 30 having a strike face generally designated by reference numeral 32. As illustrated in FIGS. 4, 4A and 4B, according to the present invention the strike face 32 is spherical and includes a concave dimple 36 with a cylindrical counterbore 38 leading into the dimple. The cylindrical counterbore 38 has a depth of at least about 0.001 inches ranging up to about 0.5 inches, and preferably is about 0.009 inches, and serves to prevent excessive flexing of the operating rod during firearm operation. In particular, the end of the operating rod may be provided with a convex surface generally complementary with the concave dimple. During the self loading process, the operating rod is subjected to considerable stress that can cause the rod to flex. If the rod flexes enough to contact the cylindrical counterbore 38, the cylindrical shape of the counterbore will act as a support for the rod to prevent further flexing. The outermost edge 37 of the strike face also preferably has a chamfered portion 31 leading into the counterbore as best seen in FIG. 4B.

The strike face 32, cylindrical counter bore 38, outermost edge 37 and chamfered portion 31 are all made with a downward angle of between about 0.05° and about 5.0°, and is preferably about 0.3°. Hence, according to a preferred embodiment, the face, counterbore, edge and chamfer are all angled downwardly, with the angle 39 as measured from the outermost edge 37 to the center axis 34 of the carrier bore 16 being between about 89.95° and about 85.0°, as shown in FIG. 4A.

Figure 5:
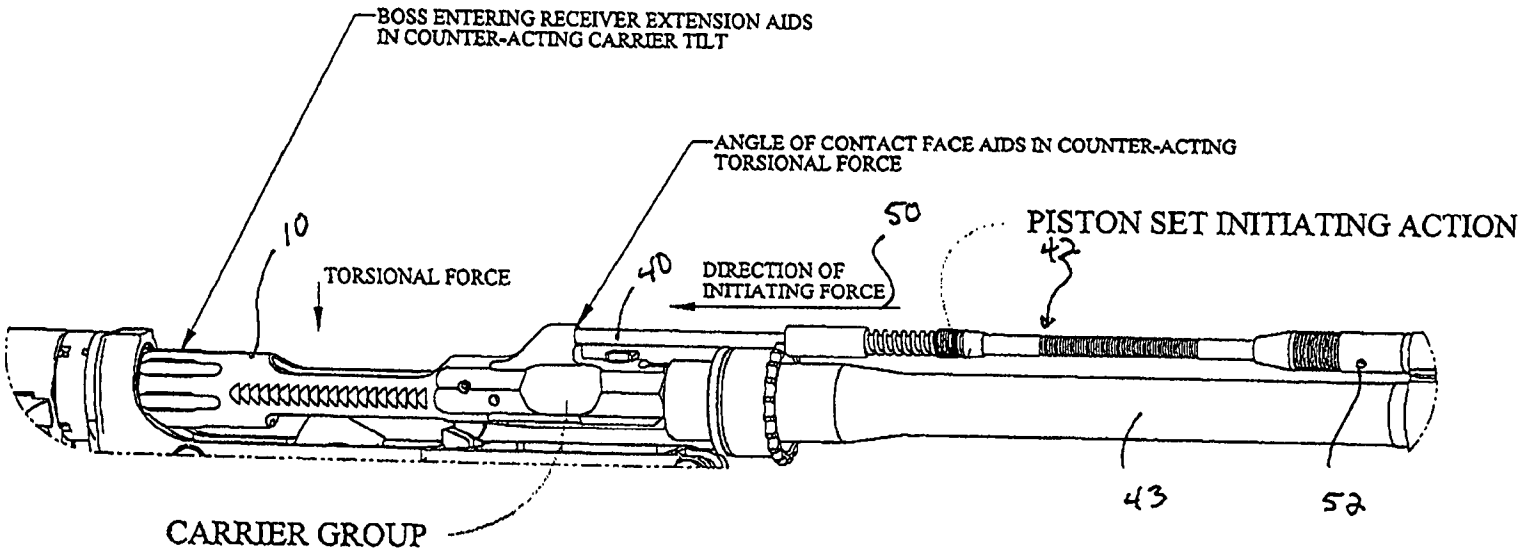
FIG. 5 is a partial perspective view of the firearm of FIG. 3 showing the forces exerted on the firearm when the action is first initiated upon firing of the weapon.

As already noted, the strike face 32 is contacted by the operating rod 40 of the weapon's gas operating system 42 when the weapon is fired. In sum, when the firearm 13 is fired, gas pressure entering the gas operating system 42 pushes the operating rod 40 rearwardly against the strike face 32 as indicated by arrow 50 shown in FIG. 5. Gas vents 52 are located at the limit of the desired operating stroke to bleed off any excess gas, preventing over-stroking. The operating rod 40 delivers a buffered impulse to the bolt carrier 10 via the strike face 32 which carrier then moves rearwardly, rotating the bolt 22 and causing it to unlock and begin the cartridge extraction process. The downward angle of the strike face 32 and counterbore 38 counteracts the off-axis force exerted by the operating rod 40 so that downward tilt of the rear 27 of the bolt carrier 10 within the receiver is prevented.

Figure 6:
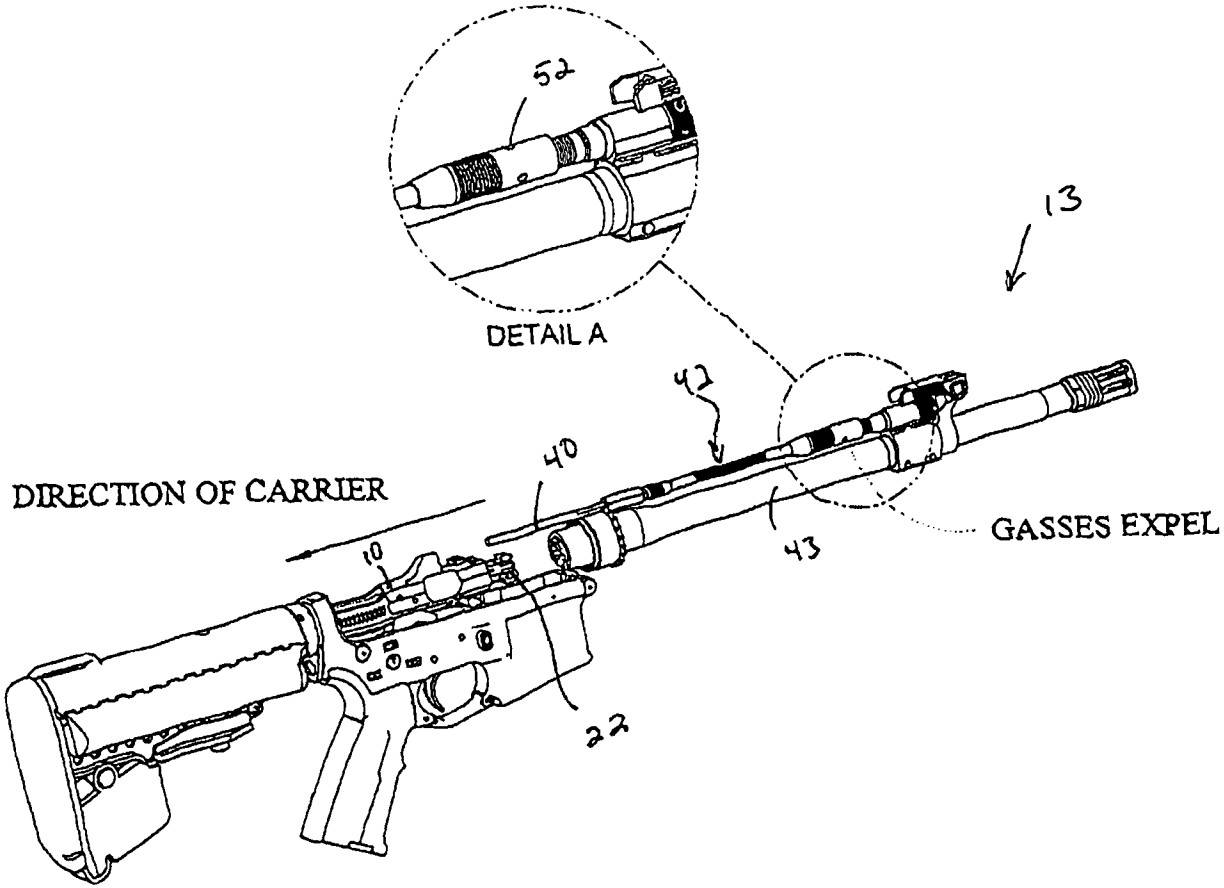
FIG. 6 shows the firearm of FIG. 5 after the operating rod, under gas pressure produced by firing, has struck the carrier key and initiated rearward movement of the bolt carrier.

As shown in FIG. 6, the bolt carrier 10, having more mass than the operating rod 40, continues to move rearwardly after the operating rod "runs out of gas", so to speak, and returns to battery under spring tension, independently of the bolt carrier motion. The bolt carrier thereafter returns to battery under the spring force of a buffer return spring (not shown) located in the stock.

In addition to the benefits of the angled strike face 32 and counterbore 38 in reducing carrier tilt, forming the carrier key 30 integrally with the carrier 10 reduces manufacturing complexity and cost. Particularly, forming the carrier key and the carrier as a single piece eliminates the need for exact machining of separate carrier and carrier key components otherwise needed to ensure a precise fit within close tolerances. With the single-piece construction, manufacture is simplified and manufacturing costs reduced.

Preferably, the rear 27 of the bolt carrier 10 is provided with a boss, generally designated by reference numeral 60, having an outer diameter 62 larger than the main body 64 of the bolt carrier 10 with cuts or flutes 66 therein for water passage, as already discussed herein and in the Gomez application.

Figure 7:
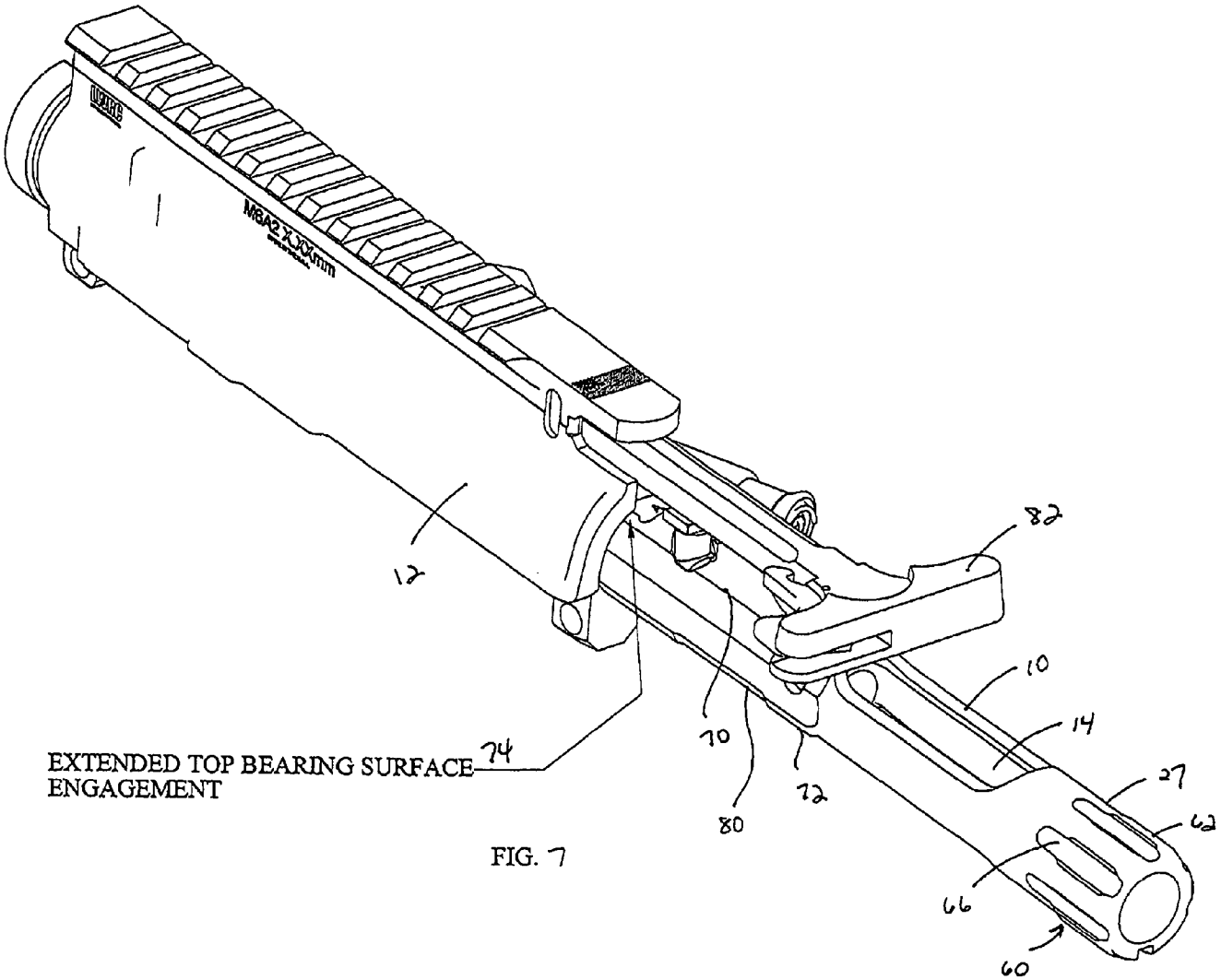
FIG. 7 is an upper perspective view of the bolt carrier of FIGS. 1 and 2 as received within the receiver.

As shown in FIGS. 1, 2, 7 and 8, the exterior of the bolt carrier 10 is provided with a series of longitudinally extending lands or rails, generally four, that include upper rails 70 and lower rails 72. The lower rails 72 extend from the front face 26 of the bolt carrier 10 rearwardly for a distance of about one-half the length of the bolt carrier. According to the present invention, the upper rails 70 are made with extensions 74 that extend forwardly to also reach the front face 26 of the bolt carrier as shown in FIGS. 1, 2 and 7. The extensions 74 lie on either side of the charging handle engagement shelf 28. The rails 70, 72, in conjunction with the boss 60, support the front 29 and rear 27 respectively, of the bolt carrier 10 to prevent the bolt carrier from tilting and wearing on the receiver 12 during the normal operation of an M16 or related firearm.

Figure 8:
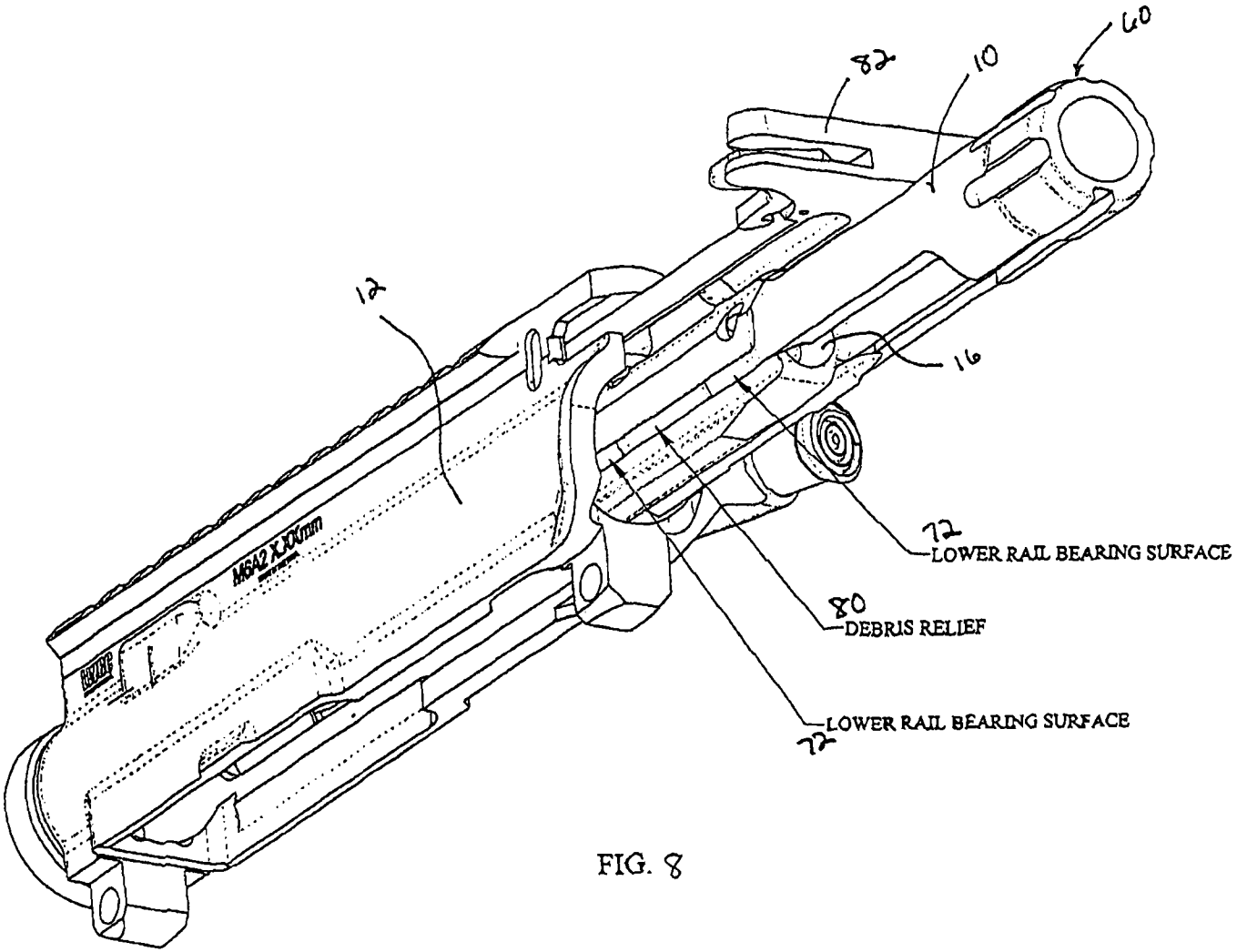
FIG. 8 is a lower perspective view of the components shown in FIG. 7.

Both the upper rails 70 and the lower rails 72, shown in FIG. 8, have debris relief cuts 80 formed therein. These cuts 80 provide a recess which captures any dirt and other debris that enters the receiver as the bolt carrier moves back and forth during firing. By accumulating the dirt, etc. in the recess 80, the weapon is not stalled by such material but can continue to operate.

Figure 9A:
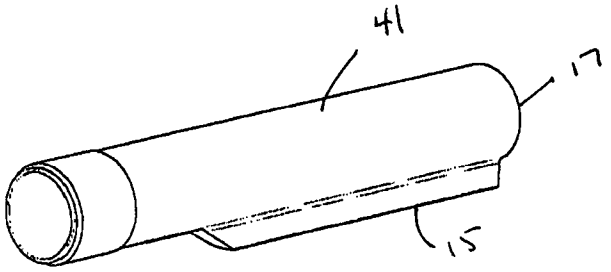
FIG. 9A is a perspective view of the receiver extension of the firearm shown in FIG. 3.
Figure 9B:
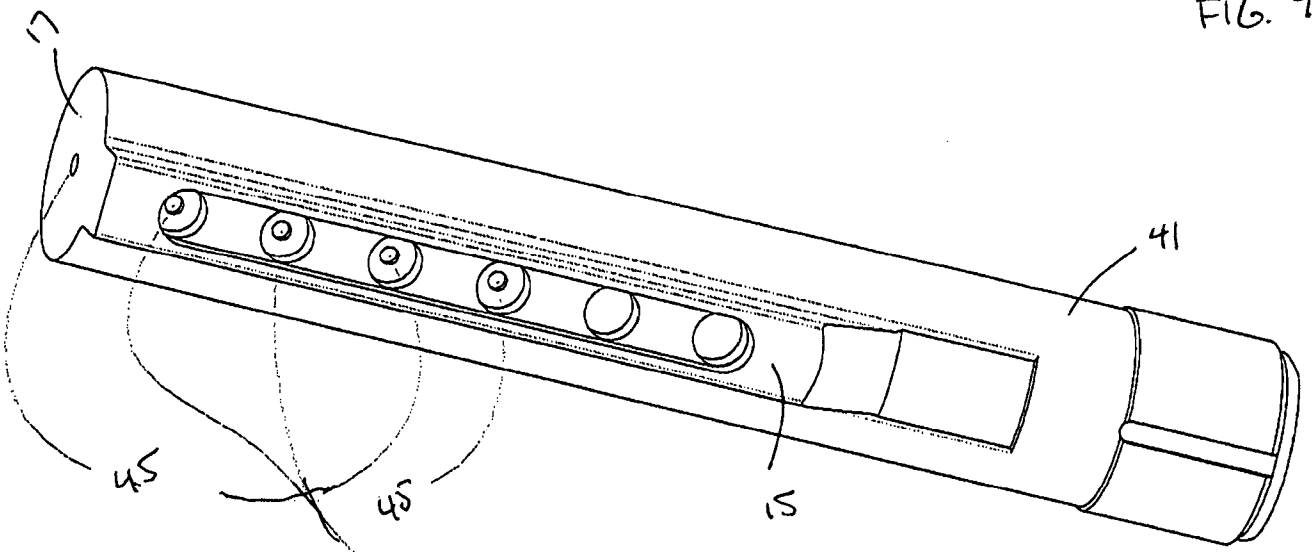
FIG. 9B is a perspective bottom view of the receiver extension shown in FIG. 9A, showing the drain holes therein.

As noted earlier, the bolt carrier 10 is received within a receiver extension 41 which is shown in isolation in FIG. 9. According to a further feature of the present invention, the bottom 15 and rear 17 of the receiver extension 41 are provided with drain holes 45 as shown in FIG. 9B for removal of water trapped in the receiver extension during over the beach operations. As noted earlier, as the weapon is fired, the bolt carrier moves rearwardly into the receiver extension 41. Water present in the receiver extension is forced, by the pumping action created by the reciprocating movement of the bolt carrier, outwardly through the drain holes 45 in the bottom 15 and rear 17 of the receiver extension 41 to empty the receiver extension of water. In addition, water can pass through the flutes 66 in the boss 60 to exit the receiver by moving past the carrier as a result of the same pumping action created by the cycling of the bolt carrier during firing. Hence, a firearm equipped with the water-draining cuts 66 and the receiver extension drain holes 45 can be immediately fired upon exit from an aquatic environment and, in the process, will automatically self-empty the receiver extension of trapped water.

Finally, to improve the durability of the weapon, the operating rod 40 is made of super alloy with high nickel and cobalt content. Such construction produces a stronger operating rod that is able to withstand repeated firing, and the considerable stresses associated therewith, over a longer lifespan than conventional rods. The super alloy is a martensitic age hardening iron-based steel alloy, essentially carbon free, with nickel and cobalt as the main alloying elements, preferably in the range of about 15% to about 22% nickel and about 5% to 15% cobalt by weight of the total material composition. The super alloy may also include minor amounts of aluminum, titanium and/or molybdenum as interstitial alloying elements. Preferred compositions have about 17% to about 19% nickel, about 7% to about 12.5% cobalt as the main alloying elements, and about 0.05% to about 0.15% aluminum, about 0.3% to about 1.6% titanium and about 4.6% to about 5.2% molybdenum as interstitial alloying elements, all by weight, with the remainder being iron. Preferred super alloys are available from ATI Allvac of Monroe, North Carolina, under the names Maraging/VascoMax C-250, Maraging/VascoMax C-300, and Maraging/VascoMax C-350.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. A bolt carrier for a gas-operated automatic or semi-automatic firearm comprising an elongated generally cylindrical body having a forward end with a front face, a rearward end, an upper exterior surface, and a lower exterior surface, said upper exterior surface having an integrally formed carrier key and strike face with a counterbore to support an operating rod in contact with the strike face, said strike face and counterbore being downwardly angled, wherein said counterbore has a depth ranging from about 0.001 inches to about 0.5 inches.

2. The bolt carrier as set forth in claim 1, wherein the strike face and counterbore are angled downwardly at an angle of between about 0.05 degrees and about 5.0 degrees.

3. The bolt carrier as set forth in claim 2, wherein the bolt carrier further includes upper rails and lower rails for contacting a receiver of said weapon, said upper rails extending up to said front face.

4. The bolt carrier as set forth in claim 3, wherein said rails have debris relief cuts formed therein to provide a recess for dirt and debris to accumulate without interfering with bolt carrier function.

5. The bolt carrier as set forth in claim 1, in combination with a gas-operated automatic or semi-automatic firearm having a receiver extension with drain holes formed therein, a rear end of said bolt carrier including an enlarged diameter boss with flutes formed therein for engaging the receiver extension to reduce carrier tilt and to provide, in conjunction with the receiver extension drain holes, for water removal from the receiver extension during firing.

6. The bolt carrier and firearm as set forth in claim 5, wherein said firearm gas-operating system includes an operating rod made of super alloy.

7. A gas-operated automatic or semi-automatic bolt action firearm comprising:

a receiver and receiver extension;

a barrel coupled to said receiver;

a bolt carrier with a bolt assembly configured to be received within said receiver, said bolt carrier having an enlarged fluted boss at a rear end thereof, wherein the enlarged fluted boss has a series of longitudinal flutes spread about the circumference of the boss, wherein said bolt carrier includes an integrally formed carrier key having a spherical strike face oriented to be contacted by said operating rod when the firearm is fired to effect said bolt assembly displacement, said spherical strike face being surrounded by a cylindrical counterbore, said carrier key strike face and counterbore being angled downwardly at an angle of between about 0.05 degrees and about 5.0 degrees, wherein said counterbore has a depth ranging from about 0.001 inches to about 0.5 inches;

a gas operating system with an operating rod for displacing the bolt assembly when the firearm is fired; and said receiver extension including drain holes in a bottom and rear thereof through which water is pumped out of the receiver extension by reciprocating action of the bolt carrier during said bolt assembly displacement.

8. The automatic or semi-automatic bolt action firearm as set forth in claim 7, wherein the bolt carrier further includes upper rails and lower rails for contacting the receiver, said upper rails extending up to a front face of said bolt carrier on either side of a charging handle engagement shelf, said rails having debris relief cuts formed therein to provide a recess for dirt and debris to accumulate without interfering with bolt carrier function.

9. An automatic or semi-automatic bolt action firearm comprising:

a receiver;

a barrel coupled to said receiver;

a bolt carrier with a bolt assembly configured to be received within said receiver, wherein said bolt carrier includes an integrally formed carrier key having a spherical strike face oriented to be contacted by said operating rod when the firearm is fired to effect said bolt assembly displacement, said spherical strike face being surrounded by a cylindrical counterbore, said carrier key strike face and counterbore being angled downwardly at an angle of between about 0.05 degrees and about 5.0 degrees, wherein said counterbore has a depth ranging from about 0.001 inches to about 0.5 inches; and a gas operating system for displacing the bolt assembly when the firearm is fired, said gas operating system including an operating rod made of super alloy with a nickel content of between about 15% and about 22% by weight of a total material composition and a cobalt content of between about 5% to about 15% by weight of the total material composition.

10. The automatic or semi-automatic bolt action firearm as set forth in claim 9, wherein the bolt carrier further includes upper rails and lower rails for contacting the receiver, said rails having debris relief cuts formed therein to provide a recess for dirt and debris to accumulate without interfering with bolt carrier function.

* * * * *